US006241587B1

(12) United States Patent
Drill et al.

(10) Patent No.: US 6,241,587 B1
(45) Date of Patent: Jun. 5, 2001

(54) SYSTEM FOR DISLODGING BY-PRODUCT AGGLOMERATIONS FROM A POLISHING PAD OF A CHEMICAL MECHANICAL POLISHING MACHINE

(75) Inventors: Charles Franklin Drill, Boulder Creek; Ian Robert Harvey, Livermore, both of CA (US)

(73) Assignee: VLSI Technology, Inc., San Jose, CA (US)

( * ) Notice: Subject to any disclaimer, the term of this patent is extended or adjusted under 35 U.S.C. 154(b) by 0 days.

(21) Appl. No.: 09/023,638

(22) Filed: Feb. 13, 1998

(51) Int. Cl.[7] ..... B24B 1/00

(52) U.S. Cl. ..... 451/56; 451/60; 451/444

(58) Field of Search ..... 451/41, 56, 60, 451/63, 72, 91, 285, 287, 443, 444, 910

(56) References Cited

U.S. PATENT DOCUMENTS 5,578,529 * 11/1996 Mullins ..... 451/41
5,616,069 * 4/1997 Walker et al. ..... 451/285
5,779,522 * 7/1998 Walker et al. ..... 451/56
5,868,608 * 2/1999 Allman et al. ..... 451/72
5,916,010 * 6/1999 Varian et al. ..... 451/72

FOREIGN PATENT DOCUMENTS

03148109 * 6/1991 (JP) .

* cited by examiner

*Primary Examiner*—Derris H. Banks
(74) *Attorney, Agent, or Firm*—Wagner, Murabito & Hao LLP

(57) ABSTRACT

A system for dislodging by-product agglomerations from a polishing pad of a chemical mechanical polishing (CMP) machine. The present invention is used in conjunction with a CMP machine that polishes semiconductor wafers. Specifically, an embodiment of the dislodging system in accordance with the present invention includes a megasonic nozzle which is adapted to effectively dislodge polishing by-product agglomerations and particles from the grooves and micro-pits of the surface of a polishing pad through the application of an output stream of extremely agitated fluid (e.g., deionized water). One embodiment of the megasonic nozzle in accordance with the present invention includes two piezoelectric transducers which operate at a resonant frequency to produce the extremely agitated stream of fluid. A fluid line is connected to the megasonic nozzle and a fluid source in order to convey fluid to the megasonic nozzle. Within one embodiment of the present invention, a megasonic nozzle is mounted on a conditioner arm of a CMP machine near the end effector. As the polishing pad of the CMP machine rotates, the megasonic nozzle and the end effector translationally move towards and away from the center of the polishing pad such that the output stream of the megasonic nozzle covers nearly the entire surface of the polishing pad.

18 Claims, 12 Drawing Sheets

400

SYSTEM FOR DISLODGING BY-PRODUCT AGGLOMERATIONS FROM A POLISHING PAD OF A CHEMICAL MECHANICAL POLISHING MACHINE

TECHNICAL FIELD

The field of the present invention pertains to semiconductor fabrication processing. More particularly, the present invention relates to a system for dislodging by-product agglomerations from a polishing pad of a chemical mechanical polishing machine.

BACKGROUND ART

Most of the power and usefulness of today's digital integrated circuit (IC) devices can be attributed to the increasing levels of integration. More and more components (resistors, diodes, transistors, and the like) are continually being integrated into the underlying chip, or IC. The starting material for typical ICs is very high purity silicon. The material is grown as a single crystal. It takes the shape of a solid cylinder. This crystal is then sawed (like a loaf of bread) to produce wafers typically 10 to 30 cm in diameter and 250 microns thick.

The geometry of the features of the IC components are commonly defined photographically through a process known as photolithography. Very fine surface geometries can be reproduced accurately by this technique. The photolithography process is used to define component regions and build up components one layer on top of another. Complex ICs can often have many different built up layers, each having components, each layer having differing interconnections, and each layer stacked on top of the previous layer. The resulting topography of these complex IC's often resemble familiar terrestrial "mountain ranges," with many "hills" and "valleys" as the IC components are built up on the underlying surface of the silicon wafer.

In the photolithography process, a mask image, or pattern, defining the various components, is focused onto a photosensitive layer using ultraviolet light. The image is focused onto the surface using the optical means of the photolithography tool, and is imprinted into the photosensitive layer. To build ever smaller features, increasingly fine images must be focused onto the surface of the photosensitive layer, i.e. optical resolution must increase. As optical resolution increases, the depth of focus of the mask image correspondingly narrows. This is due to the narrow range in depth of focus imposed by the high numerical aperture lenses in the photolithography tool. This narrowing depth of focus is often the limiting factor in the degree of resolution obtainable, and thus, the smallest components obtainable using the photolithography tool. The extreme topography of complex ICs, the "hills" and "valleys," exaggerate the effects of decreasing depth of focus. Thus, in order to properly focus the mask image defining sub-micron geometries onto the photosensitive layer, a precisely flat surface is desired. The precisely flat (i.e., fully planarized) surface will allow for extremely small depths of focus, and in turn, allow the definition and subsequent fabrication of extremely small components.

Chemical mechanical polishing (CMP) is a preferred method of obtaining full planarization of a semiconductor wafer. It involves removing a sacrificial layer or portion of sacrificial layer of dielectric material using mechanical contact between the wafer and a moving polishing pad saturated with slurry. Polishing flattens out height differences, since high areas of topography (hills) are removed faster than areas of low topography (valleys). Polishing is the only technique with the capability of smoothing out topography over millimeter scale planarization distances leading to maximum angles of much less than one degree after polishing.

FIG. 1 shows a top view of a chemical mechanical polishing (CMP) machine 100 and FIG. 2 shows a side view of the CMP machine 100. The CMP machine 100 is fed semiconductor wafers to be polished. The CMP machine 100 picks up the wafers with an arm 101 and places them onto a rotating polishing pad 102. The polishing pad 102 is made of a resilient material and is textured, often with a plurality of predetermined grooves 103, to aid the polishing process. The polishing pad 102 rotates on a platen 104, or turn table located beneath the polishing pad 102, at a predetermined speed. A wafer 105 is held in place on the polishing pad 102 within a carrier ring 112 that is connected to a carrier film 106 of the arm 101. The lower surface of the wafer 105 rests against the polishing pad 102. The upper surface of the wafer 105 is against the lower surface of the carrier film 106 of the arm 101. As the polishing pad 102 rotates, the arm 101 rotates the wafer 105 at a predetermined rate. The arm 101 forces the wafer 105 into the polishing pad 102 with a predetermined amount of down force. The CMP machine 100 also includes a slurry dispense arm 107 extending across the radius of the polishing pad 102. The slurry dispense arm 107 dispenses a flow of slurry onto the polishing pad 102.

The slurry is a mixture of deionized water and polishing agents designed to chemically aid the smooth and predictable planarization of the wafer. The rotating action of both the polishing pad 102 and the wafer 105, in conjunction with the polishing action of the slurry, combine to planarize, or polish, the wafer 105 at some nominal rate. This rate is referred to as the removal rate. A constant and predictable removal rate is important to the uniformity and throughput performance of the wafer fabrication process. The removal rate should be expedient, yet yield precisely planarized wafers, free from surface anomalies. If the removal rate is too slow, the number of planarized wafers produced in a given period of time decreases, hurting wafer throughput of the fabrication process. If the removal rate is too fast, the CMP planarization process will not be uniform across the surface of the wafers, hurting the yield of the fabrication process.

To aid in maintaining a stable removal rate, the CMP machine 100 includes a conditioner assembly 120. The conditioner assembly 120 includes a conditioner arm 108, which extends across the radius of the polishing pad 102. An end effector 109 is connected to the conditioner arm 108. The end effector 109 includes an abrasive conditioning disk 110 which is used to roughen the surface of the polishing pad 102. The conditioning disk 110 is rotated by the conditioner arm 108 and is translationally moved towards the center of the polishing pad and away from the center of the polishing pad 102, such that the conditioning disk 110 covers the radius of the polishing pad 102. In so doing, conditioning disk 110 covers the surface area of the polishing pad 102, as polishing pad 102 rotates. A polishing pad having a roughened surface has an increased number of micro-pits and gouges in its surface from the conditioner assembly 120 and therefore produces a faster removal rate. This is due in part to the increase in slurry transfer to the surface of the wafer 105 and the increase polishing by-product removal away from he surface of the wafer 105. Without conditioning, the surface of polishing pad 102 is smoothed during the polishing process and removal rate decreases dramatically. The conditioner assembly 120 re-roughens the surface of the polishing pad 102, thereby improving the removal rate by improving the transport of slurry and by-products.

As described above, the CMP process uses an abrasive slurry on a polishing pad. The polishing action of the slurry is comprised of an abrasive frictional component and a chemical component. The abrasive frictional component is due to the friction between the surface of the polishing pad, the surface of the wafer, and abrasive particles suspended in the slurry. The chemical component is due to the presence in the slurry of polishing agents which chemically interact with the material of the dielectric layer of the wafer 105. The chemical component of the slurry is used to soften the surface of the dielectric layer to be polished, while the frictional component removes material from the surface of the wafer 105.

Referring still to FIG. 1 and FIG. 2, the polishing action of the slurry determines the removal rate and removal rate uniformity, and thus, the effectiveness of the CMP process. As slurry is "consumed" in the polishing process, the transport of fresh slurry to the surface of the wafer 105 and the removal of polishing by-products away from the surface of the wafer 105 becomes very important in maintaining the removal rate. Slurry transport is facilitated by the texture of the surface of the polishing pad 102. This texture is comprised of both predefined grooves 103 and micro-pits that are manufactured into the surface of the polishing pad 102 and the inherently rough surface of the material from which the polishing pad 102 is made.

The slurry is typically transported by the grooves 103 or pits of the polishing pad 102 under the edges of the wafer 105 as both the polishing pad 102 and the wafer 105 rotate. Consumed slurry and polishing by-products, in a similar manner, are also typically transported by the grooves 103 or pits of the polishing pad 102 away from the surface of the wafer 105. As the polishing process continues, fresh slurry is continually dispensed onto the polishing pad from the slurry dispense arm 107. The polishing process continues until the wafer 105 is sufficiently planarized and removed from the polishing pad 102.

To maintain the required degree of roughness in the surface of the polishing pad 102, the conditioner assembly 120 re-roughens the surface of the polishing pad 102 to counteract the smoothing effect of friction with the wafer 105. Unfortunately, the abrasive action of the conditioning disk 110 produces debris (hereafter polishing by-product particles) comprised of particles of polishing pad material, particles of dielectric material from the wafer, particles of consumed slurry, and the like. These polishing by-product particles subsequently form agglomerations which clog the predetermined grooves 103 and micro-pits manufactured into the surface of the polishing pad 102 and reduce their ability to transport slurry and polishing by-products, adversely impacting the removal rate. Additionally, the polishing by-product particles can adhere to the surface of the wafer 105 and contribute to higher contamination levels.

Once the grooves 103 and micro-pits of polishing pad 102 become clogged with by-product agglomerations, there are several conventional procedures within the prior art to counteract this problem. The most common such procedure is to remove the polishing pad 102 and replace it with a new polishing pad, which requires significant down time of the CMP machine 100. This down time has an adverse effect on the wafer throughput of the fabrication process due to the fact that the CMP machine 100 is unusable for a significant amount of time during the change out of the polishing pad 102. Furthermore, the expense of paying maintenance personnel to remove the polishing pad 102 and install a new polishing pad adds to the disadvantages of this prior art solution.

Another prior art procedure to counteract the problem of clogged grooves 103 and micro-pits of the surface of the polishing pad 102 is to occasionally rinse the polishing pad 102 with deionized water in order to dislodge the polishing by-product agglomerations and particles. The problem with this prior art procedure is that while loose or non-embedded agglomerations and particles on the surface of polishing pad 102 are rinsed away, the procedure is not effective in dislodging the by-product particles and agglomerations in the grooves 103 and micro-pits of polishing pad 102.

Thus, what is desired is a system which improves the performance of a polishing pad in a CMP machine. What is further desired is a system which maintains a consistently high removal rate over a longer period of time. What is further desired is a system which increases the period of time a polishing pad may be utilized in a CMP machine before incurring a time consuming down time for polishing pad change out. The present invention provides these advantages.

DISCLOSURE OF THE INVENTION

The present invention comprises a system for dislodging by-product agglomerations from a polishing pad of a chemical mechanical polishing (CMP) machine used to polish semiconductor wafers. Specifically, an embodiment of the dislodging system in accordance with the present invention includes a megasonic nozzle which is adapted to effectively dislodge polishing by-product agglomerations and particles from the grooves and micro-pits of the surface of a polishing pad through the application of an output stream of extremely agitated fluid (e.g., deionized water). One embodiment of the megasonic nozzle in accordance with the present invention includes two piezoelectric transducers which operate at a resonant frequency to produce the extremely agitated stream of fluid. A fluid line is connected to the megasonic nozzle and a fluid source in order to convey fluid to the megasonic nozzle.

Within one embodiment of the present invention, a megasonic nozzle is mounted on a conditioner arm of a CMP machine near the end effector. As the polishing pad of the CMP machine rotates, the megasonic nozzle and the end effector translationally move towards and away from the center of the polishing pad such that the output stream of the megasonic nozzle covers nearly the entire surface of the polishing pad. Once the megasonic nozzle dislodges the by-product agglomerations and particles from the surface of the polishing pad, a removal system can be use to remove them from the polishing pad.

The dislodging system of the present invention in combination with a removal system improves the performance of the polishing pad by dislodging and removing the polishing by-product particles and agglomerations from the textured surface of the polishing pad. In so doing, the present invention in combination with a removal system maintains a higher removal rate over a longer period of time and increases the period of time a polishing pad may be utilized by the CMP machine before incurring an expensive down time for polishing pad change out.

In another embodiment of the present invention, the dislodging system is comprised of a plurality of fixed megasonic nozzles mounted on a conditioner arm (or other arm) of a CMP machine. The fixed megasonic nozzles are adapted to maintain close proximity with the surface of the polishing pad. As the polishing pad rotates beneath the fixed megasonic nozzles, the polishing by-product particles and agglomerations are dislodged from the surface of the polishing pad by streams of extremely agitated fluid, thereby ensuring optimal polishing conditions for the semiconductor wafer. As mentioned above, a removal system can be used to remove the dislodged particles and agglomerations from the surface of the polishing pad.

BRIEF DESCRIPTION OF THE DRAWINGS

The accompanying drawings, which are incorporated in and form a part of this specification, illustrate embodiments of the invention and, together with the description, serve to explain the principles of the invention.

Prior Art

Prior Art

BEST MODE FOR CARRYING OUT THE INVENTION

Figure 1:
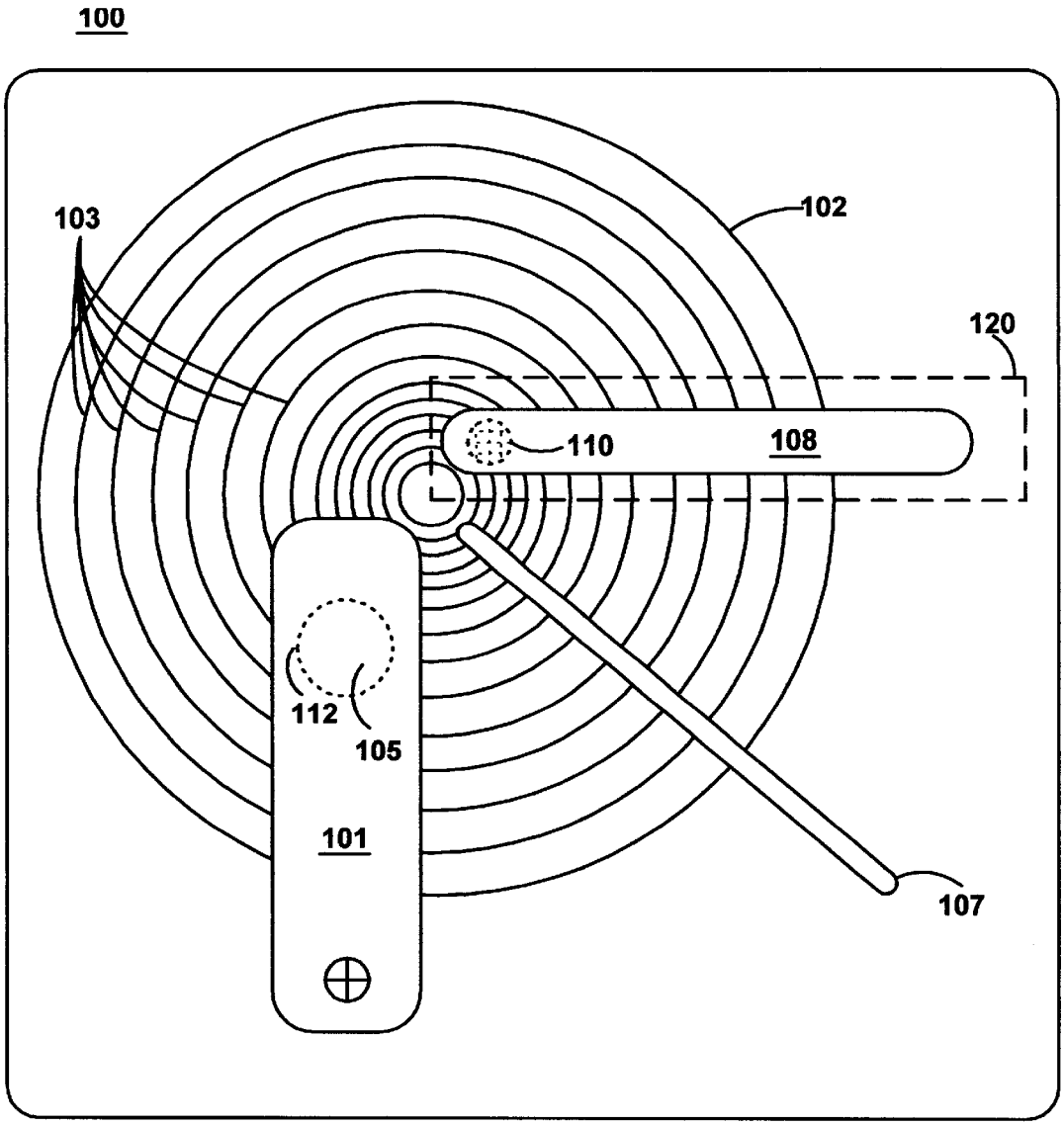
FIG. 1 (Prior Art)
FIG. 1 shows a top view of a prior art chemical mechanical polishing machine.
Figure 2:
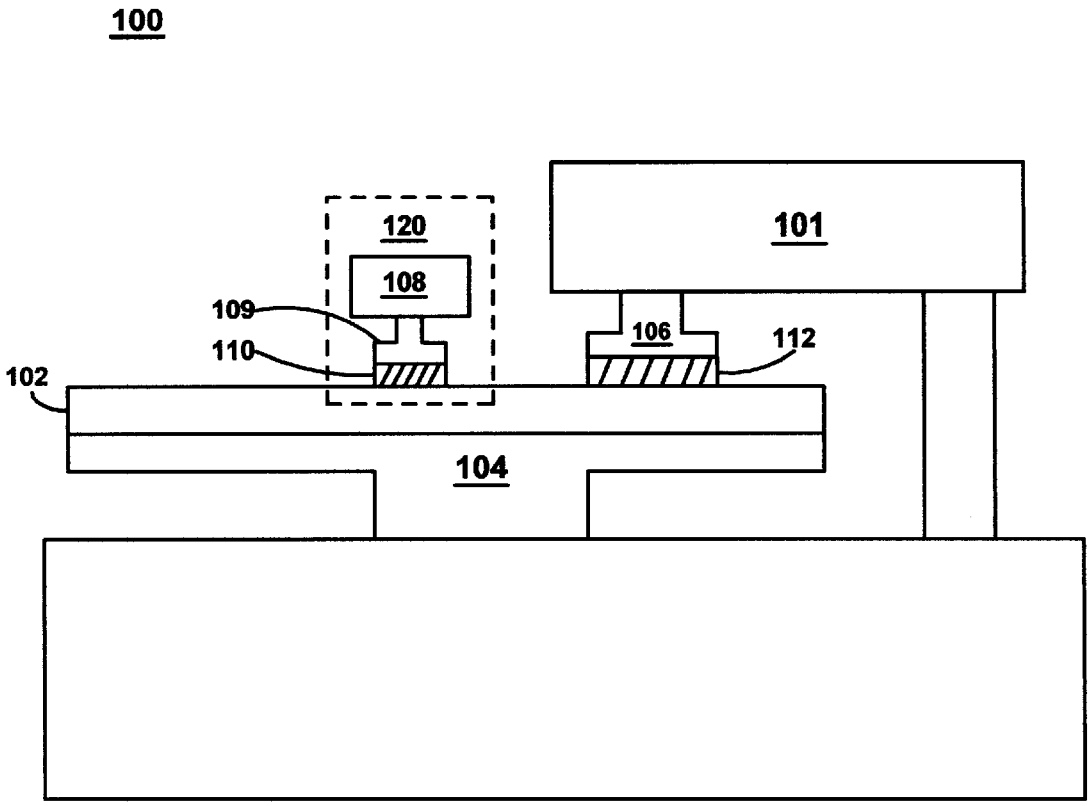
FIG. 2 (Prior Art)
FIG. 2 shows a side view of the prior art chemical mechanical polishing machine of FIG. 1.

In the following detailed description of the present invention, a system for dislodging by-product agglomerations from a polishing pad of a chemical mechanical polishing machine, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Chemical mechanical polishing (CMP) is a preferred method of obtaining full planarization of a semiconductor wafer containing devices for fabrication processing. The CMP process involves removing all, or a portion of, a layer of dielectric material using mechanical contact between the wafer and a moving polishing pad saturated with a polishing slurry. Polishing through the CMP process flattens out height differences, since high areas of topography (hills) are removed faster than areas of low topography (valleys). The CMP process has the capability of smoothing out topography over millimeter scale planarization distances, leading to maximum angles of much less than one degree after polishing.

The present invention is a system for effectively dislodging polishing by-product agglomerations and particles from the surface of a polishing pad of a CMP machine used to polish semiconductor wafers. The dislodging system in accordance with the present invention includes a megasonic nozzle which is adapted to dislodge polishing by-product agglomerations from the grooves and micro-pits of the surface of a polishing pad through the application of an output stream of extremely agitated fluid (e.g., deionized water). The megasonic nozzle is mounted to the polishing machine and a fluid line is connected to the megasonic nozzle to convey fluid to it.

The present invention improves the performance of the polishing pad by effectively dislodging the polishing by-product agglomerations from the grooves and micro-pits of the surface of the polishing pad, which can be subsequently removed from the polishing pad. In so doing, a higher removal rate is achieved over a longer period of time along with more consistent and predictable performance of the polishing pad. More predictable polishing performance reduces the use of test wafers to determine the current performance of the CMP machine, resulting in additional cost savings for the manufacturer of semiconductor wafers. In addition, the dislodging system of the present invention in combination with a removal system increases the period of time a polishing pad may be utilized by the CMP machine before incurring an expensive down time for polishing pad change out. The down time of a CMP machine is costly to a wafer manufacturer since it is time that the CMP machine is unable to process wafers. Furthermore, there is the added cost of paying maintenance personnel to remove the spent polishing pad and replace it with a new one. The dislodging system of the present invention and its benefits are described in greater detail below.

Figure 3A:
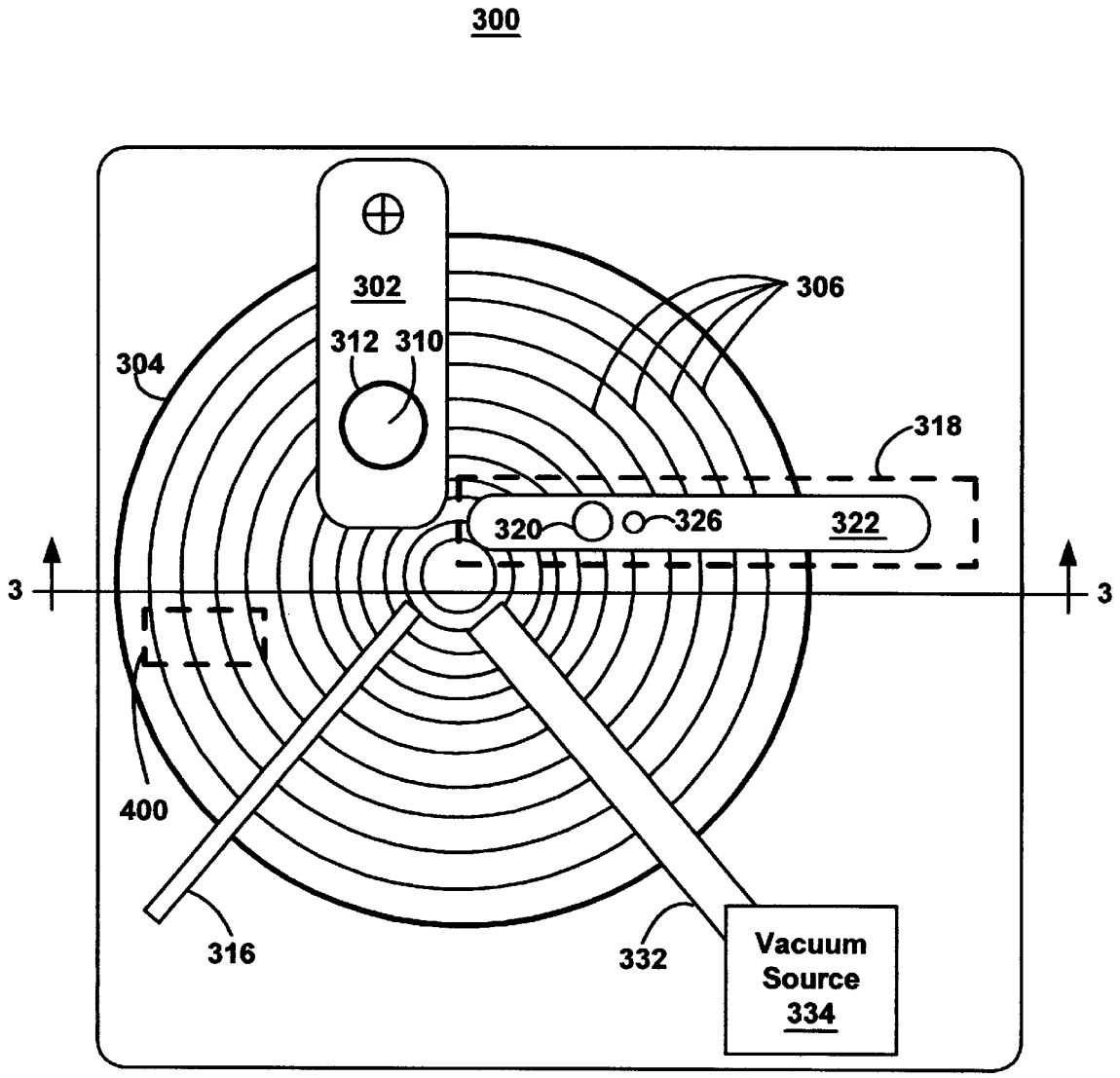
FIG. 3A shows a top view of a chemical mechanical polishing machine in accordance with one embodiment of the present invention.
Figure 3B:
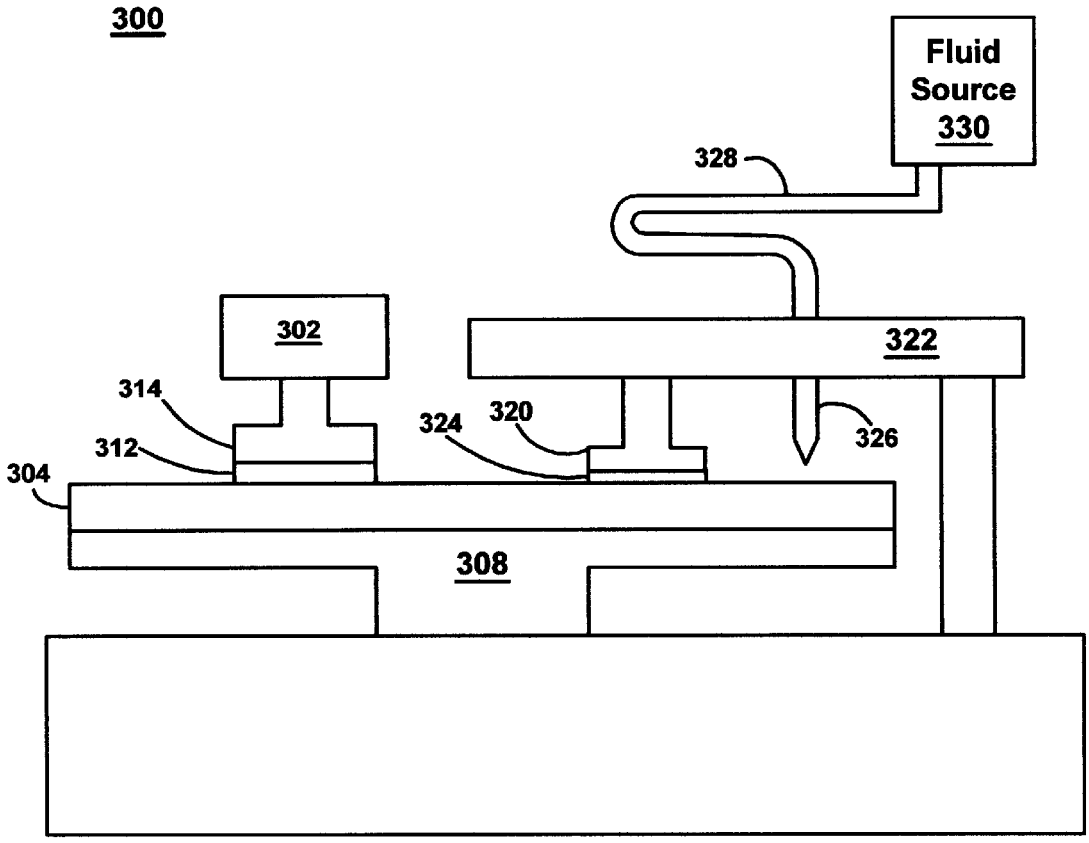
FIG. 3B shows a side sectional view of the chemical mechanical polishing machine of FIG. 3A.

FIG. 3A shows a top view of a chemical mechanical polishing (CMP) machine 300 in accordance with one embodiment of the present invention and FIG. 3B shows a side sectional view of a CMP machine 300 along line 3—3. The CMP machine 300 picks up wafer 310 with an arm 302 and places it onto the rotating polishing pad 304. The polishing pad 304 is made of a resilient material and is textured typically with a plurality of grooves 306 to aid the polishing process. As described above, the polishing pad 304 of CMP machine 300 rotates at a predetermined speed on a platen 308, or turn table located beneath the polishing pad 304. The arm 302 forces a wafer 310 into the polishing pad 304 with a predetermined amount of down force. The wafer 310 is held in place on the polishing pad 304 by a carrier ring 312 and a carrier film 314 of the arm 302. The lower surface of the wafer 310 rests against the polishing pad 304 while the upper surface of the wafer 310 is against the lower surface of the carrier film 314 of the arm 302. As the polishing pad 304 rotates, the arm 302 also rotates the wafer 310 at a predetermined rate. The CMP machine 300 also includes a slurry dispense arm 316 extending across the radius of the polishing pad 304. The slurry dispense arm 316 dispenses a flow of slurry onto the polishing pad 304. The CMP machine 300 further includes a conditioner assembly 318 which consists of a conditioner arm 322 which extends across the radius of the polishing pad 304 and an end effector 320. The end effector 320 is connected to the conditioner arm 322 and includes an abrasive disk 324 that is used to roughen the surface of the polishing pad 304, in the manner described above.

In the present embodiment, a single megasonic nozzle 326 of FIGS. 3A and 3B is mounted on the conditioner arm 322. It should be appreciated that the name "megasonic nozzle" is used as a general term which includes numerous types of ultrasonic nozzles, megasonic nozzles, and any type of nozzle that is able to generate an output stream of extremely agitated fluid. As the polishing pad 304 rotates in the clockwise direction, the megasonic nozzle 326 and the end effector 320 translationally move towards and away from the center of the polishing pad 304 such that the output stream of the megasonic nozzle 326 covers nearly the entire surface of the polishing pad 304. The megasonic nozzle 326 is adapted to produce an extremely agitated stream of fluid (e.g., deionized water) which is directed towards the polishing pad 304. The extreme agitating action of the stream of fluid produced by the megasonic nozzle 326 forcibly dislodges polishing by-product agglomerations and very minute particles from the grooves 306 and micro-pits of the surface of the polishing pad 304.

One embodiment of the megasonic nozzle 326 of FIGS. 3A and 3B utilizes two piezoelectric transducers that operate at a resonant frequency of 1 megahertz to produce an extremely agitated stream of fluid. The transducers within the megasonic nozzle 326 can operate in accordance with the present invention within a wide range of resonant frequencies (e.g., 20 kilohertz to 3 megahertz) to produce the extremely agitated stream of fluid. It should be appreciated that the range of resonant frequencies in which the megasonic nozzle 326 can operate is not strictly limited to values listed above.

A fluid line 328 of FIG. 3B is connected to the megasonic nozzle 326 and to a fluid source 330 (e.g., deionized water), such that the fluid line 328 conveys fluid from the fluid source 330 to the megasonic nozzle 326. It should be appreciated that there are numerous functional configurations and mounting locations for the megasonic nozzle 326 (e.g., two megasonic nozzles 326 can be mounted on either side of the end effector 320). As such, the present invention is equally well suited to employ differing configurations and mounting locations for the megasonic nozzle 326.

A removal system can optionally be used in conjunction with the dislodging system of the present invention in order to improve the performance of the polishing pad 304 of FIGS. 3A and 3B. For instance, a vacuum removal nozzle 332 can be used to apply suction to the surface of the polishing pad 304 in order to remove the polishing by-product particles and agglomerations which were dislodged from the surface of the polishing pad 304 by the megasonic nozzle 326. The vacuum removal nozzle 332 is connected to a vacuum source 334, such that the vacuum source 334 provides a suction force to the vacuum removal nozzle 332. The polishing by-product particles and agglomerations removed from the surface of the polishing pad 304 by the vacuum removal nozzle 332 are received by the vacuum source 334 and discharged into a container (not shown). In the present embodiment, the polishing platen 308 rotates in a clockwise direction, such that the polishing pad 304 is conditioned by the conditioner assembly 318, is "cleansed" by the megasonic nozzle 326, is vacuumed by the vacuum removal nozzle 332, receives fresh slurry from the slurry dispense arm 316, and frictionally contacts the wafer 310, thus ensuring optimal polishing conditions for the wafer 310.

It should be appreciated that once the polishing by-product particles and agglomerations are dislodged from the polishing pad 304 of FIGS. 3A and 3B by the megasonic nozzle 326, there are numerous removal processes in accordance with the present invention to remove them from the surface of the polishing pad 304 (e.g., an ancillary flush system, a vacuum system, or a combination of an ancillary flush and vacuum system). As such, the present invention is equally well suited to employ any type of removal process to remove dislodged polishing by-product particles and agglomerations from the surface of the polishing pad 304.

Figure 4A:
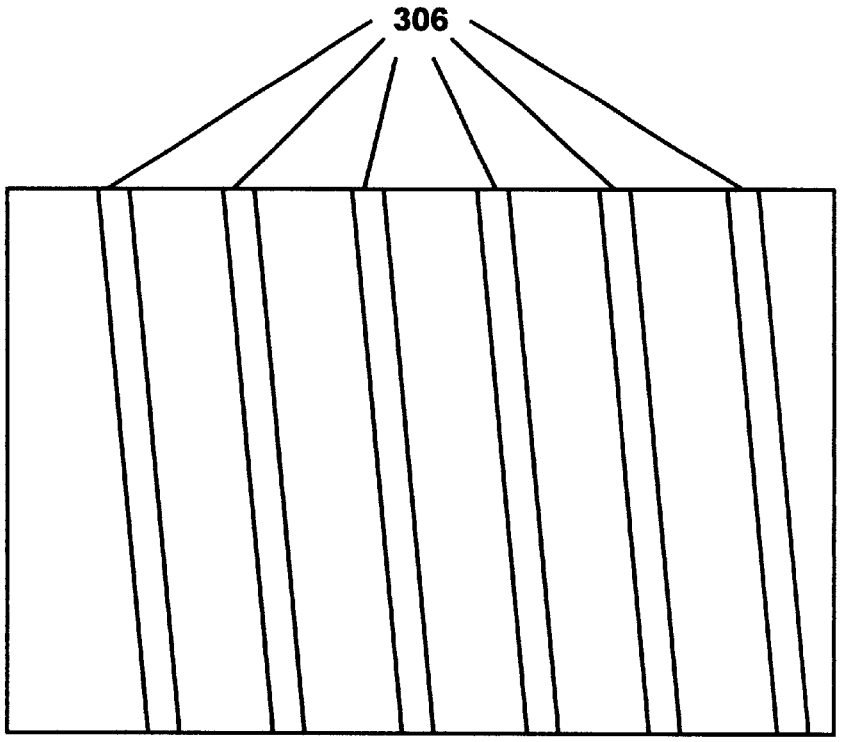
FIG. 4A shows a top view of an enlarged portion of the polishing pad of FIG. 3A.
Figure 4B:
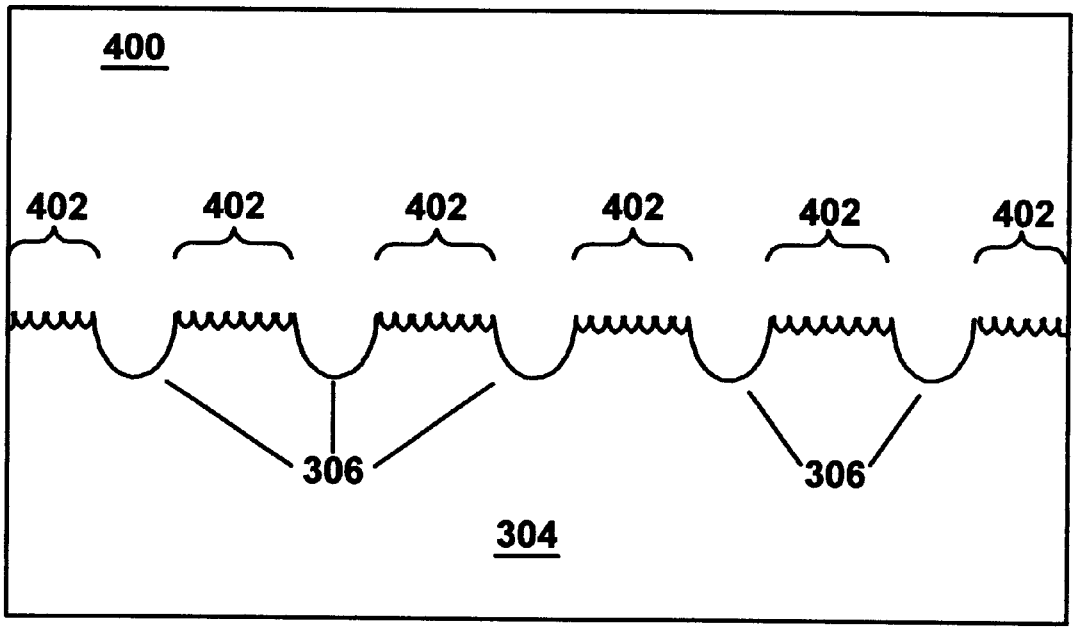
FIG. 4B shows an enlarged side view of the portion of the polishing pad of FIG. 4A.

FIG. 4A shows a top view of an enlarged portion 400 of the polishing pad 304 (FIG. 3A) and FIG. 4B shows an enlarged side view of the portion 400 of the polishing pad 304. Polishing pad 304 includes a plurality of preformed grooves 306 (hereafter grooves 306) manufactured directly into the material of the polishing pad 304. The grooves 306 function by transporting fresh slurry to the surface of the wafer 310 and transporting polishing by-products away from the surface of the wafer 310. As slurry saturates the polishing pad 304, the grooves 306 become filled with slurry. As the wafer 310 frictionally slides across the surface of the polishing pad 304, slurry adheres to the grooves 306 and scrapes past the edges of the carrier ring 312 and into contact with the lower surface of the wafer 310. In addition to the grooves 306, slurry adheres to the actual texture asperity of the material (micro-pits 402) comprising the surface of the polishing pad 304, and is transported under the edges of the carrier ring 312 and into contact with the lower surface of the wafer 310. Thus, in the present embodiment, the texture of the surface of the polishing pad 304 is comprised of the preformed grooves 306 and the micro-pits 402.

The lower surface of the wafer 310 of FIG. 3A is polished by the chemical action of the slurry, e.g., chemically softening the dielectric layer, and the frictional action of the slurry abrasive particles and polishing pad micro-pits 402 of FIG. 4B. Thus, as both the polishing pad 304 and the wafer assembly rotate, slurry is "consumed," along with some amount of the micro-pits 402 of the surface of the polishing pad 304. Consumed slurry and polishing by-products, in a similar manner, also adhere to the micro-pits 402 of the polishing pad 304 and are transported away from the surface of the wafer 310. As the polishing process continues, fresh slurry is continually dispensed onto the polishing pad 304 from the slurry dispense arm 316. The polishing action of the slurry filling and adhering to the grooves 306 and the micro-pits 402 determines the removal rate of the wafer 310 and the removal rate uniformity, and thus, the effectiveness of the CMP process. As slurry is consumed, the transport of fresh slurry to the surface of the wafer 310 and the removal of polishing by-product particles away from the surface of the wafer 310 becomes very important in maintaining the removal rate. The present invention ensures that the grooves 306 and the micro-pits 402 remain clear of polishing by-product agglomerations and particles, and are thus fully able to transport slurry.

Figure 5A:
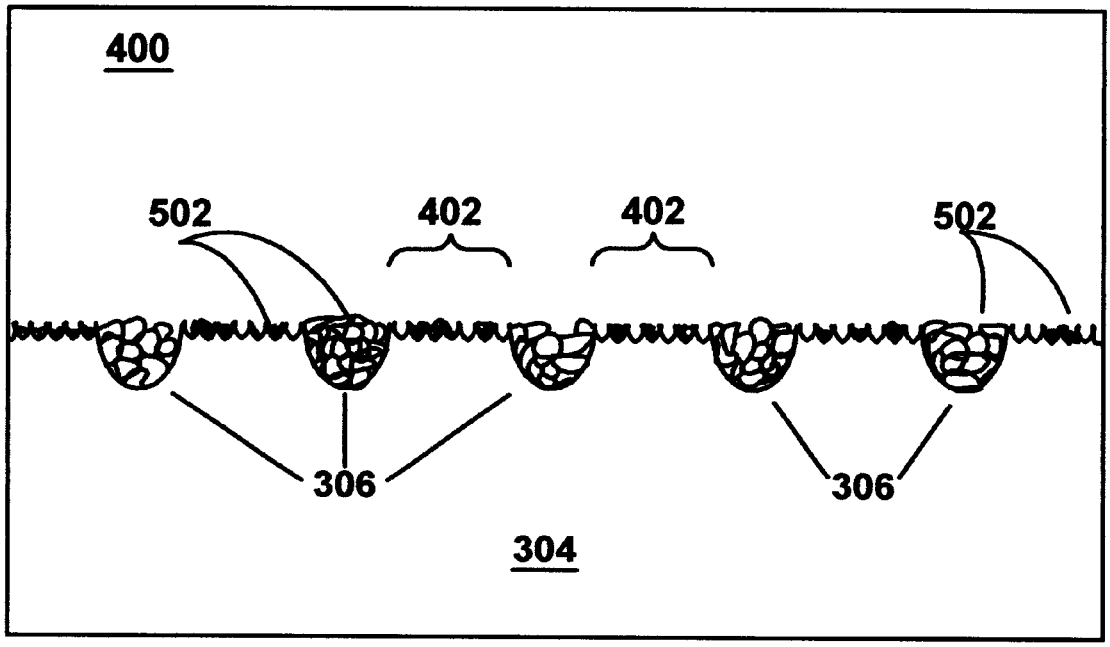
FIG. 5A shows an enlarged side view of a portion of a polishing pad subsequent to the polishing process and conditioning by a conditioner assembly.

FIG. 5A shows a side view of the enlarged portion 400 of the polishing pad 304 subsequent to the polishing process and the conditioning by the conditioner assembly 318 of FIG. 3A. To maintain the required degree of roughness of the surface of the polishing pad 304, the conditioner assembly 318 re-roughens the surface of the polishing pad 304 in the manner described above. The abrasive action of the conditioner assembly 318 produces debris comprised of particles of polishing pad material. The particles of polishing pad material, particles of dielectric material from the wafer 310, particles of consumed slurry, and the like, form by-product agglomerations 502 which subsequently clog the predetermined grooves 306 and the micro-pits 402 which reduces their ability to transport slurry, thereby, adversely impacting the removal rate. Additionally, the by-product agglomerations 502 adhere to the surface of the wafer 310 and contribute to higher contamination levels. The megasonic nozzle 326 (FIG. 3B) of the present invention effectively dislodges the by-product agglomerations 502 through the application of a stream of extremely agitated fluid directed towards the surface of the polishing pad 304.

Figure 5B:
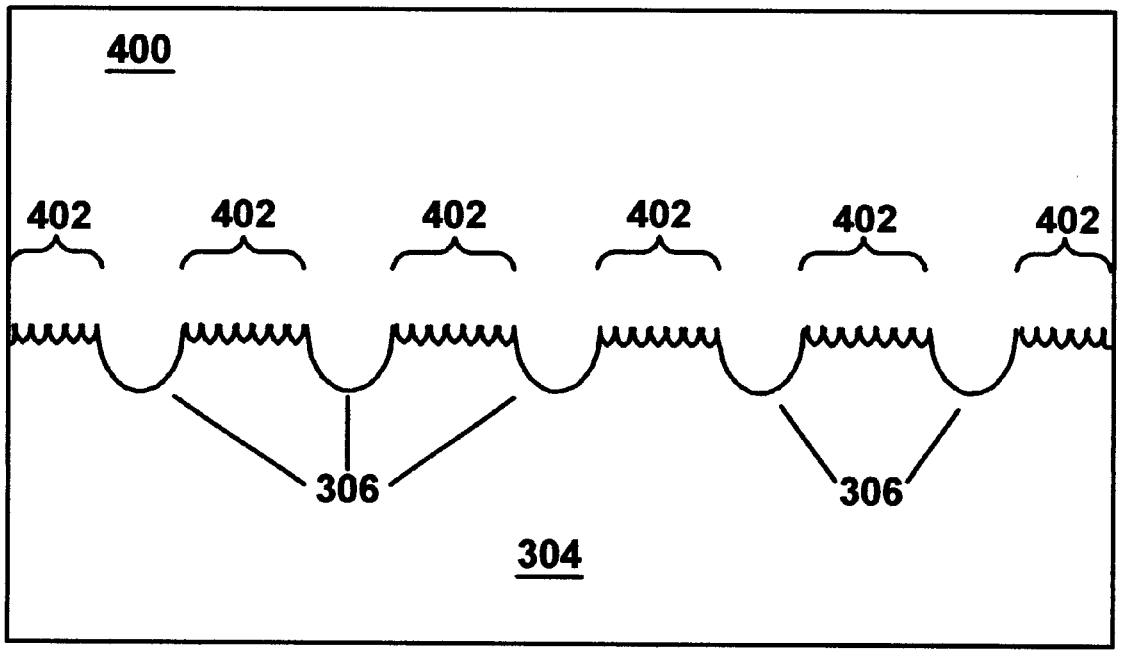
FIG. 5B shows a side view of the portion of the polishing pad of FIG. 5A subsequent to the dislodging action in accordance with the present invention in conjunction with a removal system.

FIG. 5B shows a side view of the enlarged portion 400 of the polishing pad 304 subsequent to the dislodging action in accordance with the present invention in conjunction with a removal system. The by-product agglomerations 502 have been dislodged from the predetermined grooves 306 and the micro-pits 402 of the polishing pad 304 by the megasonic nozzle 320 of FIGS. 3A and 3B and subsequently removed by the vacuum nozzle 332. In addition to removing by-product agglomerations 502, spent slurry has also been removed by the vacuum nozzle 332. The predetermined grooves 306 and the micro-pits 402 are subsequently saturated by fresh slurry from the slurry dispense arm 316 prior to contact with the wafer 310.

Figure 6A:
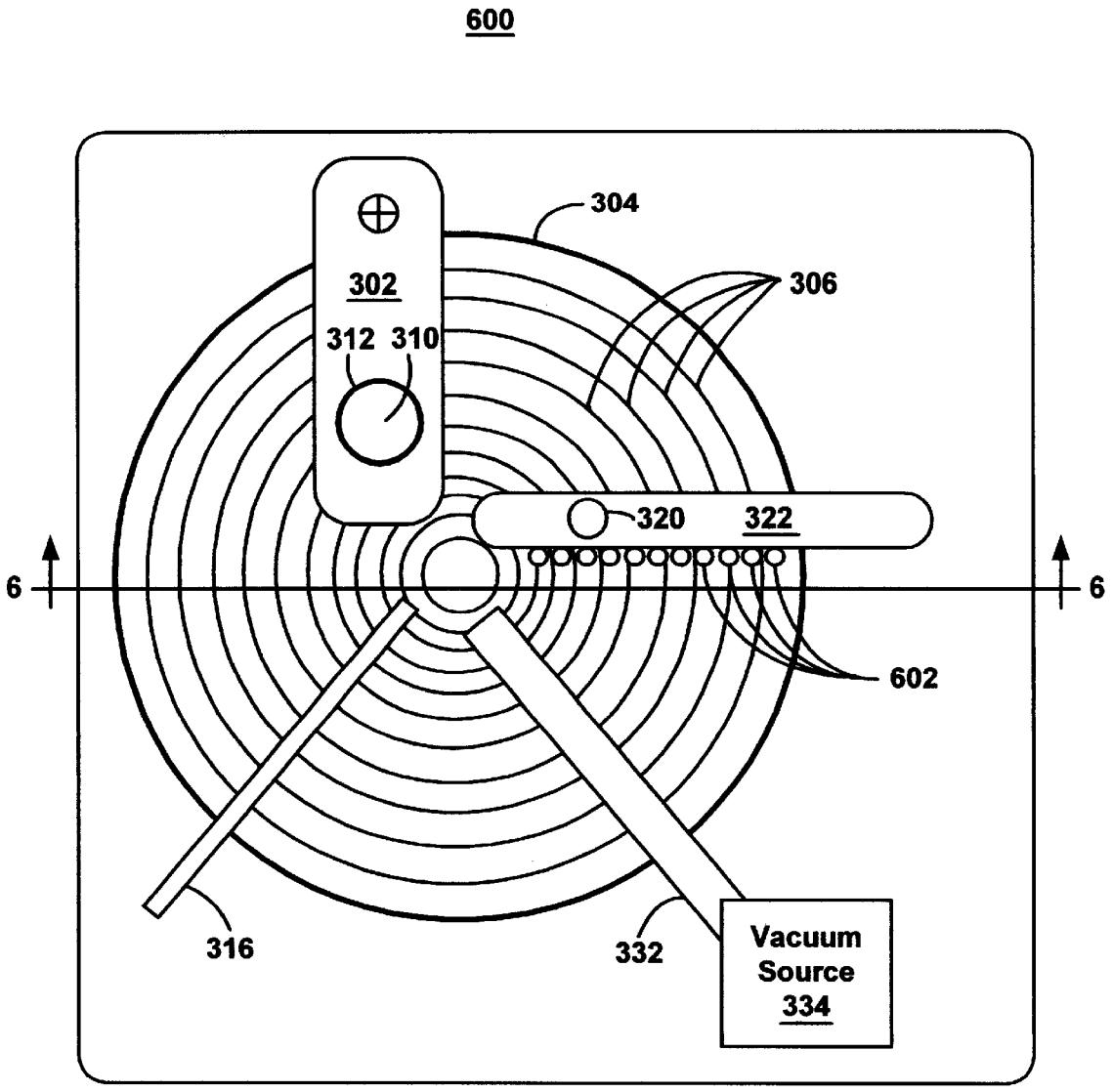
FIG. 6A shows a top view of a chemical mechanical polishing machine in accordance with another embodiment of the present invention.
Figure 6B:
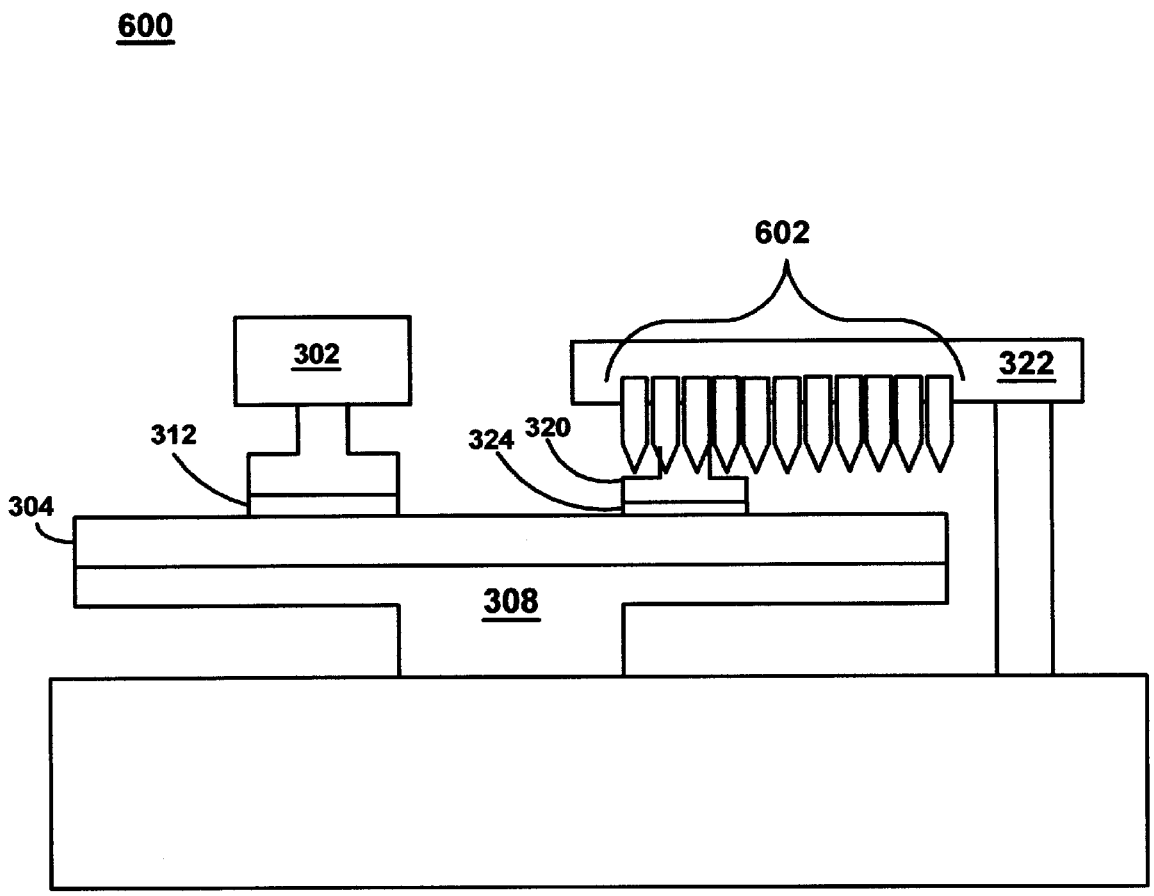
FIG. 6B shows a side sectional view of the chemical mechanical polishing machine of FIG. 6A.

FIG. 6A shows a top view of a CMP machine 600 in accordance with another embodiment of the present invention. FIG. 6B shows a side sectional view of the CMP machine 600 along line 6—6. In this embodiment, a plurality of megasonic nozzles 602 are mounted on the conditioner arm 322. It is appreciated that even though it is not shown within FIGS. 6A and 6B, a fluid source (e.g., deionized water) supplies the plurality of megasonic nozzles 602 with fluid via fluid lines. As the polishing pad 304 rotates beneath the megasonic nozzles 602, the output streams from the megasonic nozzles 602 cover nearly the entire surface area of the polishing pad 304. The megasonic nozzles 602 are mounted on the conditioner arm 322 in such a manner as to dislodge polishing by-product agglomerations and particles from the surface of the polishing pad 304 with streams of extremely agitated fluid immediately after polishing pad 304 is roughened by the abrasive disk 324. It should be appreciated that there are numerous functional configurations and mounting locations for the plurality of fixed megasonic nozzles 602 (e.g., fixed megasonic nozzles 602 can be mounted on a separate mounting attachment). As such, the present invention is equally well suited to employ differing configurations and mounting locations for the plurality of megasonic nozzles 602.

Figure 7:
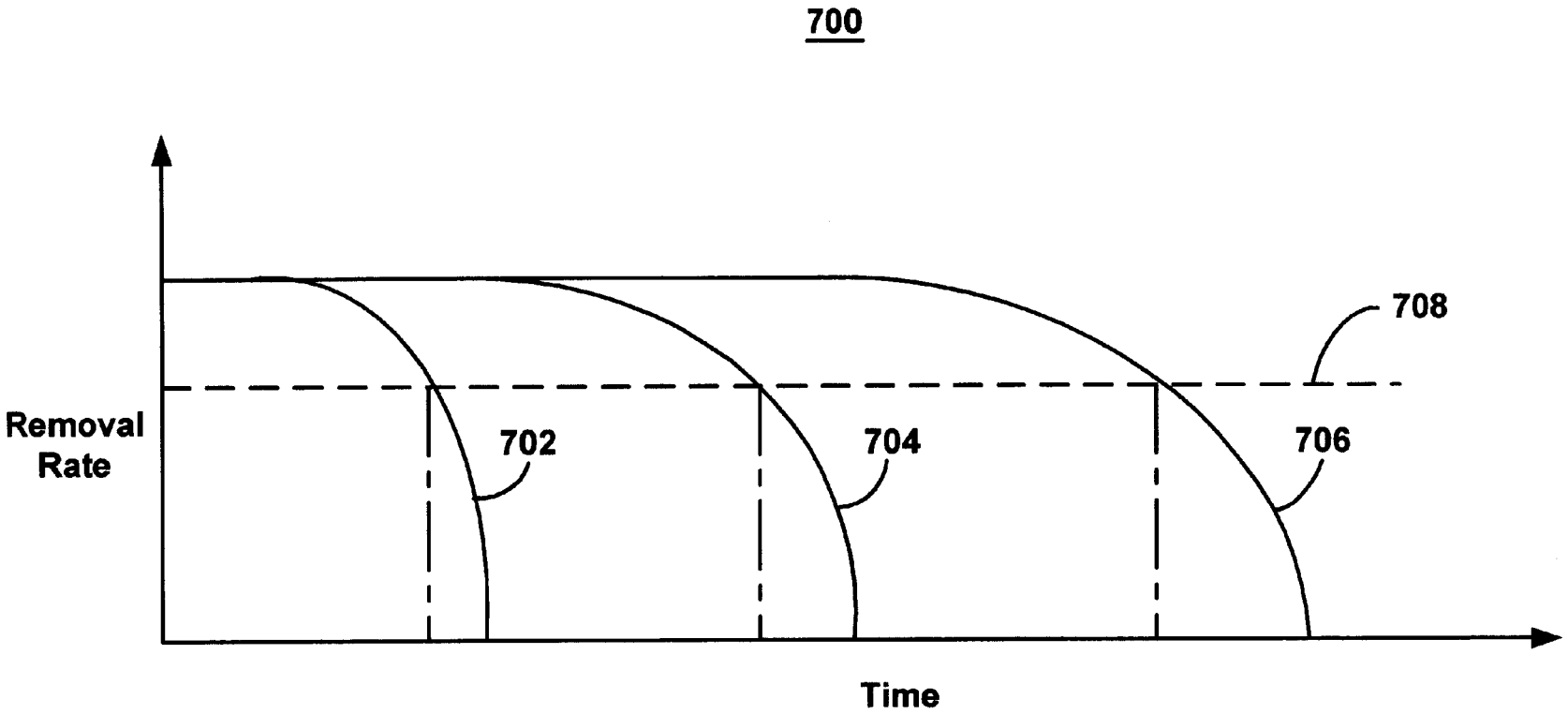
FIG. 7 shows a graph of the removal rate with respect to time of a chemical mechanical polishing machine in accordance with the present invention.

Referring now to FIG. 7, a graph 700 of the removal rate with respect to time for a CMP machine in accordance with the present invention is shown. The graph 700 shows three different cases of CMP processing. Line 702 shows the removal rate over time of a CMP machine processing a wafer without conditioning of the polishing pad and without the dislodging and removal of polishing by-product agglomerations and particles. Line 704 shows the removal rate over time of a CMP machine processing a wafer with conditioning of the polishing pad and with the dislodging of polishing by-product agglomerations and particles but without the removal of polishing by-product agglomerations and particles. Line 706 shows the removal rate over time of a CMP machine processing a wafer with conditioning of the polishing pad and with the dislodging and removal of polishing by-product agglomerations and particles.

The slurry used in the CMP machine, a mixture of deionized water and polishing agents, is designed to chemically aid the smooth and predictable planarization of the wafer. The rotating action of both the polishing pad and a wafer, in conjunction with the polishing action of the slurry, combine to planarize a wafer at a nominal rate referred to as a removal rate. A constant predictable removal rate is important to the uniformity and performance of the wafer fabrication process. The removal rate should be expedient, yet yield precisely planarized wafers, free from surface anomalies. If the removal rate is too slow, the number of planarized wafers produced in a given period of time decreases, hurting the wafer through-put of the fabrication process. If the removal rate is too fast, the CMP planarization process will not be uniform across the surface of the wafers, hurting the yield of the fabrication process. By employing the dislodging system of the present invention in conjunction with a removal system, the removal rate (line 706) is maintained above a minimum "quality threshold" represented by line 708 for the longest period of time in comparison to line 704 and line 702.

Polishing without conditioning the polishing pad and without dislodging and removal, line 702 of FIG. 7, results in rapid drop off of removal rate due to the fact that the polishing process results in a gradual erosion of the surface micro-pits of the polishing pad. The erosion of the surface micro-pits adversely impacts the rate at which slurry flows to the surface of the wafer, resulting in the rapid drop off of removal rate as successive wafers are polished. Thus, line 702 quickly falls below the quality threshold 708, thereby causing a greater number of CMP machine down times for polishing pad change out.

Polishing with conditioning and dislodging in accordance with the present invention but without a removal process, line 704 of FIG. 7, results in a less rapid drop off of removal rate in comparison to line 702 due to the fact that the gradual erosion of the surface texture of the polishing pad is counteracted by the conditioning and dislodging processes. The conditioner assembly roughens the surface of the polishing pad, maintaining adequate surface texture for a longer period of time. The abrasive action of the conditioner assembly, however, produces particles of polishing pad material, which aid in forming by-product agglomerations that clog the predetermined grooves and micro-pits of the polishing pad, as described above. The dislodging system in accordance with the present invention is able to dislodge the by-product agglomerations and particles from the grooves and micro-pits of the polishing pad resulting in a less rapid drop off of removal rate. The dislodging action of the present invention, however, does not adequately remove the dislodged by-product agglomerations from the polishing pad, resulting in the agglomerations being moved to different areas of the polishing pad and eventually aiding in the clogging of the predetermined grooves and micro-pits of the polishing pad. The clogging effects of these by-product agglomerations leads to the gradual reduction in the rate of slurry flow to the wafer as successive wafers are polished. Thus, line 704 results in a less rapid drop off of removal rate in comparison to line 702, however, a greater number of CMP machine down times for polishing pad change out are required in comparison to conditioning in conjunction with the dislodging of the present invention and a removal process, line 706.

Referring still to FIG. 7, polishing with conditioning and dislodging in accordance with the present invention along with a removal process, line 706, results in an even less rapid drop off of removal rate in comparison to lines 704 and 702. As the conditioner assembly roughens the surface of the polishing pad, the polishing by-product agglomerations and particles are dislodged and removed from the predetermined grooves and micro-pits of the polishing pad in the manner described above. The dislodging process of the present invention along with a removal process greatly decreases the clogging effects of the by-product agglomerations, and in so doing, greatly decreases the gradual reduction in the rate of slurry flow to the wafer attributable to the clogging effects. Thus, line 706 results in a longer "service life" of the polishing pad and longer consistent periods of operation between time consuming down times for polishing pad change out. The longer service life has a positive effect on the fabrication throughput of CMP machines in accordance with the present invention.

The dislodging and removal of by-product agglomerations and particles from the polishing pad reduces the amount of contamination of the wafers attributable to the adherence of by-product particles and agglomerations to the surface of the wafers. As an even further benefit, CMP processing in accordance with the present invention, line 706 of FIG. 7, maintains the stability of the removal rate for longer periods of time in comparison to line 704 and line 702. The drop off in removal rate is slower and more predictable. These characteristics are important to maintaining acceptable uniformity of removal, i.e., the relative planarity of the surface of the dielectric layer of the wafer after polishing.

Figure 8:
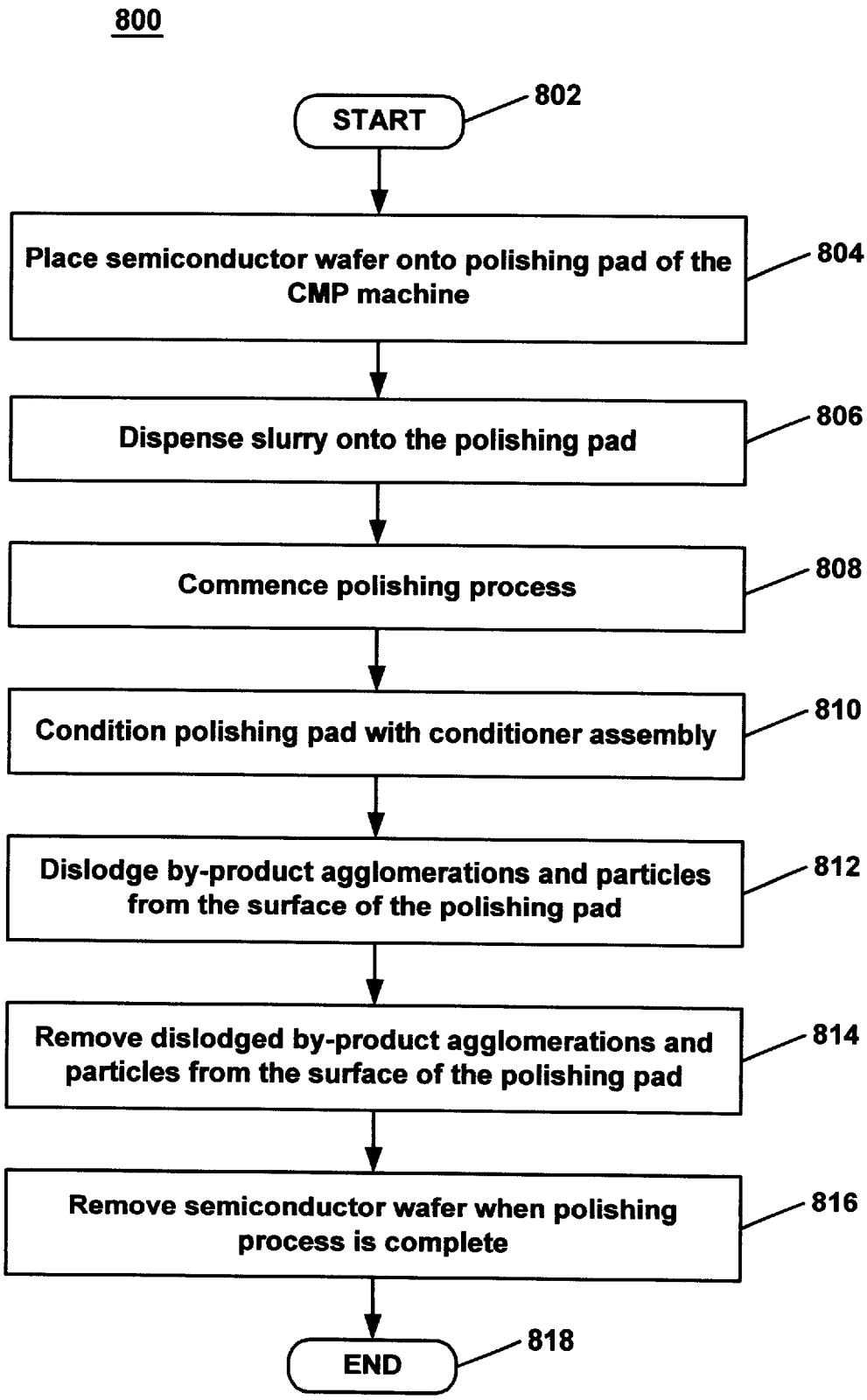
FIG. 8 shows a flowchart of the steps of a dislodging process in accordance with one embodiment of the present invention.

Referring now to FIG. 8, a flow chart of the steps of the dislodging process 800 in accordance with one embodiment of the present invention is shown. Process 800 is used to polish wafers to the proper degree of planarization using the dislodging system of the present invention. Process 800 starts at step 802 and proceeds to step 804. Within step 804, the arm of the chemical mechanical polishing (CMP) machine grabs a semiconductor wafer to be polished and places it onto the rotating polishing pad of the CMP machine. The polishing pad is previously coated with a layer of slurry. The slurry is dispensed from a slurry dispense arm, as described above.

During step 806 of FIG. 8, a flow of slurry containing polishing agents is dispensed onto the polishing pad. The flow of slurry of step 806 maintains a coating of slurry on the polishing pad.

During step 808 of FIG. 8, the wafer is confined by the arm of the CMP machine to the polishing pad as the polishing pad rotates. In addition to the polishing pad rotating during step 808, the wafer is also rotated by the arm and the polishing process is carried out by the combined motion of both the polishing pad and the wafer. During step 808, the friction of the wafer against the polishing pad, in conjunction with the action of the slurry, removes material from the wafer at a nominal removal rate.

In step 810 of FIG. 8, the polishing pad is roughened by the conditioning assembly.

During step 812 of FIG. 8, polishing by-product agglomerations and particles are dislodged from the surface of the polishing pad using an extremely agitated stream of fluid in accordance with the present invention. The extremely agitated stream of fluid of step 812 can be generated by any of the numerous embodiments of the megasonic nozzle in accordance with the present invention.

Within step 814 of FIG. 8, the polishing by-product agglomerations and particles are removed from the surface of the polishing pad by a removal process. The removal process of step 814 can be performed by a vacuum system, an ancillary flush system, a combination of a vacuum and ancillary flush system, or any other type of removal process.

In step 816 of FIG. 8, the semiconductor wafer is removed from the polishing pad of the CMP machine when the polishing process is complete and the wafer is sufficiently planarized.

Process 800 of FIG. 8 is then exited during step 818.

Thus, the dislodging system of the present invention in combination with a removal system improves the performance of a polishing pad in a CMP machine and maintains a higher and more consistent removal rate over a longer period of time. In addition, the dislodging system of the present invention in conjunction with a removal system increases the period of time a polishing pad may be utilized in a CMP machine before incurring a time consuming down time for polishing pad change out.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A dislodging system for dislodging polishing by-product particles from the surface of a polishing pad of a chemical mechanical polishing machine used to polish semiconductor wafers, comprising:

a polishing pad of a chemical mechanical polishing machine having a textured surface to carry a slurry;

a nozzle that operates at a megasonic resonant frequency to produce and output an extremely agitated stream of fluid, wherein said extremely agitated stream of fluid is used to dislodge polishing by-product particles from said textured surface of said polishing pad of said chemical mechanical polishing machine, wherein said extremely agitated stream of fluid is not a slurry;

a mounting attachment coupled to said nozzle, said mounting attachment further coupled to said chemical mechanical polishing machine and for maintaining close proximity of said nozzle with said textured surface of said polishing pad;

a fluid line coupled to said nozzle, said fluid line for conveying a fluid to said nozzle; and a fluid source coupled to said fluid line, said fluid source for providing said fluid to said nozzle.

2. A dislodging system as described in claim 1 further comprising:

a plurality of said nozzle, said plurality of nozzles coupled to said mounting attachment.

3. A dislodging system as described in claim 1 wherein said megasonic nozzle further comprises:

a transducer adapted to operate at said resonant frequency in order to produce said extremely agitated stream of fluid.

4. A dislodging system as described claim 3 wherein:

said mounting attachment is a conditioner arm of said chemical mechanical polishing machine; and said nozzle is able to translationally move across said polishing pad to cover an area of said polishing pad.

5. A dislodging system as described in claim 3 wherein said fluid is deionized water.

6. A dislodging system as described in claim 3 wherein said extremely agitated stream of fluid is deionized water.

7. A dislodging system as described in claim 6 further comprising:

a removal system to remove said polishing by-product particles dislodged from said textured surface of said polishing pad by said nozzle.

8. A dislodging system as described in claim 7 wherein said removal system is a vacuum removal system.

9. A dislodging system as described in claim 7 wherein said removal system is an ancillary flush system.

10. A dislodging system as described in claim 6 wherein said nozzle is able to dislodge said polishing by-product particles from a plurality of micro-pits formed into said textured surface of said polishing pad.

11. A dislodging system as described in claim 10 wherein said nozzle is able to dislodge said polishing by-product particles from a plurality of predetermined grooves formed into said textured surface of said polishing pad.

12. A dislodging system for dislodging polishing by-products from a polishing pad of a chemical mechanical polishing machine used for polishing semiconductor wafers, comprising:

a semiconductor wafer detachably mounted on said chemical mechanical polishing machine;

a polishing pad mounted on said chemical mechanical polishing machine for polishing said semiconductor wafer, said semiconductor wafer disposed against said polishing pad, said polishing pad is able to be frictionally moved against said semiconductor wafer by said chemical mechanical polishing machine, said polishing pad having a textured surface to carry fresh slurry to said semiconductor wafer and carry away consumed slurry and polishing by-product agglomerations and particles from said semiconductor wafer; and a nozzle that operates at a megasonic resonant frequency to produce and output an extremely agitated stream of fluid, wherein said extremely agitated stream of fluid is used to dislodge said polishing by-product agglomerations and particles from said textured surface, said nozzle mounted on said polishing machine such that said nozzle maintains close proximity with said textured surface of said polishing pad as said textured surface moves beneath said nozzle, wherein said extremely agitated stream of fluid is not a slurry.

13. A dislodging system as described in claim 12 further comprising:

a plurality of said nozzle.

14. A dislodging system as described in claim 12 wherein said nozzle further comprises:

a transducer for operating at said megasonic resonant frequency in order to produce said extremely agitated stream of fluid.

15. A dislodging system as described in claim 14 further comprising:

a fluid line coupled to said nozzle, said fluid line for conveying a fluid to said nozzle; and a fluid source coupled to said fluid line, said fluid source for providing said fluid to said nozzle.

16. A dislodging system as described in claim 15 further comprising said nozzle mounted to a conditioner arm of said chemical mechanical polishing machine, said nozzle is able to move translationally across said polishing pad to cover an area of said polishing pad.

17. A dislodging system as described in claim 15 wherein said fluid is deionized water.

18. A dislodging system as described in claim 14 wherein said extremely agitated stream of fluid is deionized water.

* * * * *